US005269100A

United States Patent [19]

Fontenot

[11] Patent Number: 5,269,100

[45] Date of Patent: Dec. 14, 1993

[54] DOOR SECURITY DEVICE AND METHOD

[76] Inventor: Albert M. Fontenot, 11614 Riderwood, Houston, Tex. 77099

[21] Appl. No.: 959,756

[22] Filed: Oct. 13, 1992

[51] Int. Cl.[5] ..... E06B 3/30

[52] U.S. Cl. ..... 49/460; 49/503

[58] Field of Search ..... 49/503, 462, 460, 504; 292/340, 346, DIG. 55; 52/514; 70/416–418

[56] References Cited

U.S. PATENT DOCUMENTS

| | | | |
|---|---|---|---|
| 3,673,605 | 6/1972 | Allenbaugh | 292/346 |
| 3,764,173 | 10/1973 | Griffith | 292/346 |
| 3,815,945 | 6/1974 | Lamphere | 292/340 |
| 4,397,168 | 8/1983 | Rotondi et al. | 70/417 |
| 4,953,901 | 9/1990 | Hegdahl | 292/346 X |
| 5,076,626 | 12/1991 | Tiddy et al. | 49/460 X |
| 5,127,690 | 7/1992 | Kim et al. | 292/346 X |

*Primary Examiner*—Philip C. Kannan
*Attorney, Agent, or Firm*—Browning, Bushman, Anderson & Brookhart

[57] ABSTRACT

A door security device for enhancing structural integrity between a door and a doorjamb includes a generally U-shaped door reinforcing member, a reinforced striker plate, and securing members. The door security device may be installed on a door including a door latching device and having a bolt member selectably movable within the doorjamb to secure the door to the doorjamb when the door is closed. A cut-out within the end plate of the door reinforcing member has at least a selected vertical height, and the reinforcing member and striker plate are mounted to the door and doorjamb, respectively, such that the striker plate is received within the cut-out when the door is closed without the latching plate overlapping the end plate of the door reinforcing member. Since the edge of the door is closely adjacent the doorjamb and striker plate, the door reinforcing member may be stamped from relatively thick stock having a substantially uniform thickness, thereby reducing manufacturing costs.

20 Claims, 1 Drawing Sheet

DOOR SECURITY DEVICE AND METHOD

FIELD OF THE INVENTION

The present invention relates to security devices and, more particularly, to an improved door security device and method for preventing unauthorized intrusion. The present invention is particularly designed to deter "kick-in" and pry-in burglaries by both enhancing the structural integrity of the door and providing a more reliable door/door jamb connection.

BACKGROUND OF THE INVENTION

Increasing crime has led to the recent marketing of numerous security protection devices. Many of these systems are quite elaborate and thus expensive, and merely provide a warning signal of authorized intrusion into a dwelling or building. Such little time is required by experienced robbers, kidnappers, vandals, and other criminals, however, that warning systems are frequently ineffective, particularly in high-crime areas where police and other security personnel response time is high. Other security devices are designed to make unauthorized intrusion more difficult. Although those knowledgeable in the field of security frequently prefer these devices to mere warning systems, many of these security devices are also expensive and unsightly, and are substantially ineffective.

While improved techniques and equipment are required to deter various types of unauthorized intrusion, there has long been an unsatisfied demand for systems that will deter "kick-in" and pry-in burglaries. Some dwellings have elaborate door/doorjamb connection mechanisms, but the door itself can merely be kicked in within a few seconds by an experienced criminal. To be successful, this kick-in approach need not overcome the door/doorjamb connection, since the bulk of the door body can be separated from the relatively small door portion to which the security device is mounted. While U-shaped reinforcement devices have been used to increase the structural integrity of the door, these prior art devices are also largely ineffective at preventing "kick-in" and pry-in burglaries, and are difficult to install. These latter devices result in increased spacing between the door edge and the opposing face of the doorjamb, which actually encourages the use of a crowbar or other prying mechanism to obtain unauthorized entry since a strong bar end can now be pressed between the door and doorjamb.

The disadvantages of the prior art are overcome by the present invention, and an improved security device is hereinafter disclosed. The device according to the present invention may include various modifications, although each of these embodiments overcomes most, if not all, of the disadvantages of the prior art discussed above. The device of the present invention is relatively inexpensive, is highly reliable, may be easily installed by inexperienced personnel, requires no special installation tooling, and when installed is attractive rather than unsightly.

SUMMARY OF THE INVENTION

The present invention is directed to a door security device for preventing unauthorized intrusion and, more particularly, is directed to a device that simultaneously increased the structural integrity of a door while providing a reliable door/doorjamb connection, thereby significantly reducing the likelihood of a "kick-in" or pry-in entry.

The device of the present invention, which may be generally described as a door reinforcer kit, comprises a heavy-duty striker plate that is securable to a standard doorjamb by plurality of hardened screws, and a U-shaped reinforcing member. The reinforcing member may be secured to a standard door by conventional screws, and may be provided with a recess in each of the side plates for fitting about a standard dead bolt or lock set mounted on the door.

The device of the present invention significantly increases structural integrity of the door while not increasing the spacing between the edge of the door and the doorjamb. These features are obtained by providing a cut-out in the end plate of the reinforcing member, which has a vertical height sufficient to receive the vertical length of the heavy-duty striker plate. This concept allows both the striker plate and reinforcing member to be ideally fabricated from relatively thick sheet metal stock. The door reinforcing member is mounted to the doorjamb such that its side plates and end plate are in planar engagement with the inner and outer faces and end face of the door, respectively. The striker plate is mounted to the doorjamb such that the striker plate is received within the cut-out in the end plate of the reinforcing member when the door is closed. Since the striker plate does not overlap the end plate of the reinforcing member, the space between the end of the door and the doorjamb is minimized. This use of a relatively thick metal stock for the reinforcing member achieves the door structural integrity desired, and the reinforcing member may be easily installed without removing or replacing the existing dead bolt or lock set assembly secured to the door since recessed portions of each side plate are configured to accept a variety of dead bolt and lock set constructions. The striker plate is preferably mounted to the doorjamb with hardened steel screws to further enhance structural integrity.

It is an object of the present invention to provide a relatively simple yet highly effective device to reduce unauthorized entry. The device of the present invention utilizes a striker plate and door reinforcing member, each designed to cooperate with the other component to achieve this objective in a reliable manner. It is an object of the invention to form and mount the door reinforcing member and striker plate to a door and doorjamb, respectively, in a manner that enables these components to cooperate with each other in the desired manner. Another object of this invention is to significantly improve security with the device which, once installed, neither requires the owner's action or conduct to activate the device, nor detracts from the desired aesthetics of the door.

It is particular feature of this invention that the striker plate and reinforcing member are each configured such that the striker plate fits within a recess provided in the end plate of the reinforcing member, and that no portion of the end plate overlaps the striker plate when the door is closed. A related feature of the invention is to form and mount the components in a manner such that the striker plate does not overlap the end plate of the reinforcing member when the door is closed. It is a further feature of the invention that the kit may be applied to a door with a standard dead bolt or lock set. Yet another feature of the invention is that the kit may be easily and quickly installed by relatively inexperienced personnel.

It is an advantage of the invention that the striker plate may be secured to the doorjamb with relatively long and hardened screws. Yet another advantage of the invention is that the striker plate, and particularly the door reinforcing member, may be coated and/or finished. The reinforcing plate is configured such that it will not become damaged or marred during normal installation, or during normal use of the door on which the reinforcing member is mounted.

These and further objects, features, and advantages of the present invention will become apparent from the following detailed description, wherein reference is made to the figures in the accompanying drawing.

DETAILED DESCRIPTION OF PREFERRED EMBODIMENTS

Figure 1:
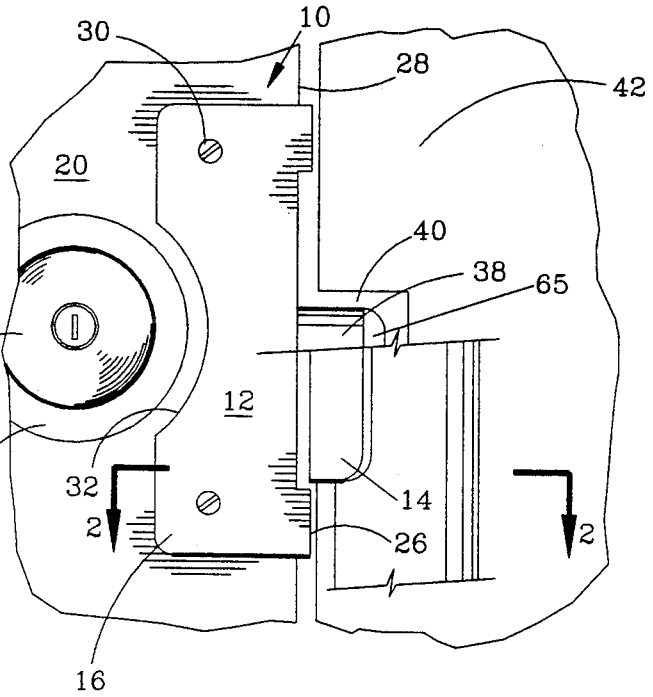
FIG. 1 is a simplified pictorial view of one embodiment of the door security device according to the present invention.
Figure 2:
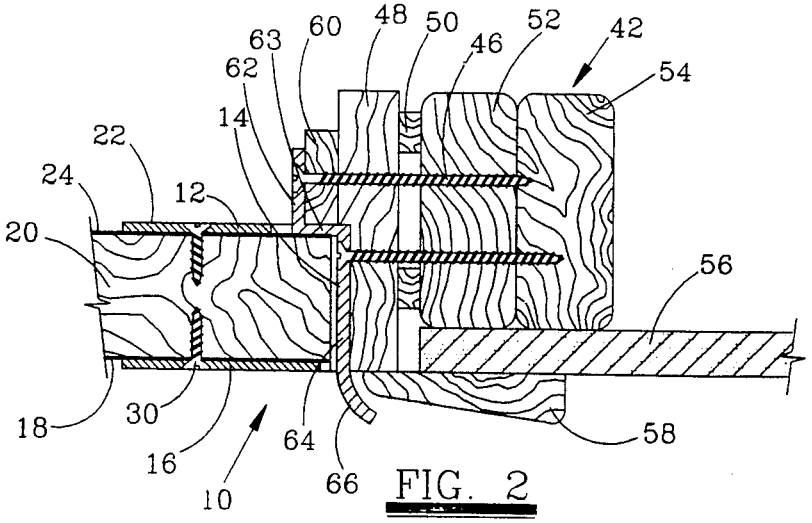
FIG. 2 is a cross-sectional view of the door security device shown in FIG. 1.

FIG. 1 depicts a door security device 10 according to the present invention, comprising a door reinforcing member 12 having a generally U-shaped cross-sectional configuration as discussed below, and a reinforced striker plate 14. Components 12 and 14, in combination with selected wood screws or other securing members discussed subsequently, may be marketed as a door reinforcing kit and may be easily and quickly installed by relatively inexperienced personnel on a standard door and door frame utilizing conventional tools. FIGS. 1 and 2 depict the door reinforcing member 12 installed on a conventional door, with one side plate 16 being in planar engagement with the inner face 18 of door 20. Another opposing and substantially parallel side plate 22 is in planar engagement with an outer face 24 of the door. End plate 26 interconnects the side plate 16 and 18, and is substantially perpendicular to each of these side plates for planar engagement with the end face 28 of the door. The door reinforcing member may be mounted to the door 20 using wood screws that pass through suitable mounting holes 31 in the side plates, as shown in FIGS. 2 and 3.

Referring again to FIG. 1, the door 20 includes a conventional door latching device 34 extending between faces 18 and 24 of the door. A handle or knob 36 is provided for manual activation of the device 24 in a conventional manner to selectively move bolt member 38 outward from the end face of the door into receptacle 40 conventionally provided in the doorjamb 42 and thereby secure the door to the doorjamb when the door is closed. This bolt member 38 may be moved inward into the door and away from receptacle 40 to release the door from the jamb by rotating knob 36.

Figure 3:
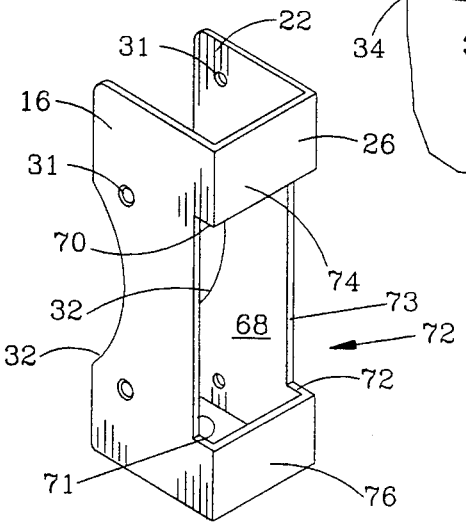
FIG. 3 is a pictorial view of the door reinforcing member generally shown in FIGS. 1 and 2.

Each of the side plates 16, 22 includes a recess 32 as shown in FIGS. 1 and 3 for receiving at least a portion of the door latching device 34. This feature enhances the structural integrity of the door reinforcing member by allowing this member 12 to be mounted to a conventional door without removing or replacing the door latching device. To enhance the desired structural integrity of the door, it is preferable that at least one of the plates 16, 22 extends inward and away from the end face 28 of the door a distance that would, in the absence of recess 32, otherwise cause the side plate to engage the door latching device 34. By providing recesses 32, at least a portion of each of the plates 16, 22 above and below the latching device 34 may thus extend inward to the desired extent. The plates 16, 22 may extend further away from the edge 28 of the door than depicted in FIG. 1, in which case deeper or fuller generally U-shaped recesses may be provided in each of the side plates for receiving the door latching device. Alternatively, the plates 16, 22 may extend inward significantly further than depicted in the exemplary embodiment shown in the figures, in which case the recess may be a circular hole in one plate and an elongated U-shaped recess in the other plate for fitting the door reinforcing member about the door latching device. The door latching device 34 may be of any conventional dead bolt or lock set types, and the bolt 38 may be a dead bolt or a spring-biased latching dog. The reinforcing kit of the present invention is particularly well suited for enhancing the structural integrity of a door with a "long stroke" dead bolt.

FIG. 2 is a cross-sectional view of FIG. 1 below the dead bolt 38 and receptacle 40. The door jamb 42 is shown in greater detail, and includes a doorjamb face board 48 conventionally spaced from wooden 2×4 52 by a pair of spacer strips 50. A second 2×4 54 is conventionally provided for increasing structural integrity of the doorjamb. Sheetrock 56 may be installed between these 2×4's and internal molding 58. The door stop strip 60 is secured to the face board 48 to position the door when closed.

The striker plate 14 comprises a main plate portion 64 in planar engagement with the outer face of face board 48, and an internal bent portion 66 for striking engagement with the bolt 38, i.e., for pressing a biased outward bolt 38 into the door during closure of the door. The main plate portion 64 includes an aperture 65 for receiving the bolt 38 for allowing the bolt to pass into the receptacle 40.

Door stop plate portion 63 is fixed substantially perpendicularly to portion 64, and engages an edge of stop strip 60. The door engages strip 60 when the door is closed rather than planar portion 63, since the striker plate "fits" within the cut-out 68 and need not engage the door reinforcing plate 22. The striker plate also includes an external plate portion 62 that is fixed substantially perpendicular to portion 63 and thus substantially parallel to portion 64. External plate portion 62 has one or more through holes, and portion 64 preferably has similar through holes, each for receiving wooden screw 46 or other securing member for fixedly mounting the striker plate to the doorjamb 42. The screws 46 are preferably hardened screws that have a length of approximately three inches or more to extend through face board 48, through the 2×4 52, and preferably into the backup 2×4 54 to securely fasten the striker plate to the doorjamb. Each of the wooden screws may be designed to withstand a shear force of approximately 1,000 lbs.

FIG. 3 depicts further details with respect to the door reinforcing plate 12. The cut-out 68 in the face plate 26 results in upper plate portion 74 and lower plate portion 76 each covering the edge face 28 of the door. The cut-out 68 has a vertical height of a selected distance, which is equal to or greater than the vertical length of the striker plate. This feature ensures that the striker plate 14 may be received within the cut-out 68 when the door is closed, and that the striker plate does not overlap the end plate portion 74, 76 of the reinforcing member. The cut-out 68 has a substantially uniform horizontal width extending fully between the side plates 16, 22. FIGS. 2 and 3 also depict that the interior plate 16 has a substantially rectilinear cutback defined by opposing edges 70 and back edge 71, with this cutback extending to the cut-out 68. The cutback in plate 16 also receives the striker plate 14 when the door is closed, and back edge 71 is ideally recessed from the end plate 26 a distance slightly greater than the thickness of the end plate 26. Plate 22 has a similar rectangular-shaped cutback defined by opposing edge surfaces 72 and back edge 73, and also extends to the cut-out 68 to receive the striker plate. The back edge 73 in the exterior plate 22 is recessed further from plate 26 than back edge 71 in order to accommodate plate portions 63, 62 of the striker plate 14. When the plates 12 and 14 are assembled on a door and doorjamb, respectively, the back edge 73 is spaced slightly from plate portion 62, as shown in FIG. 2. It should now be understood how the cut-out in the door reinforcing plate cooperates with the striker plate to substantially minimize the spacing between the edge of the door and the doorjamb to prevent a pry bar from being pressed between the door and jamb. This close spacing of the edge of the door and the doorjamb would not be possible if the striker plate overlapped the end plate of the door reinforcing member, unless the thickness of the striker or the end plate of the door reinforcing member were substantially reduced.

The door reinforcing striker plate of the present invention may be fabricated from metal stock, and the form of each member may be cut out in a stamping operation utilizing metal stock of a substantially uniform thickness. The cut-outs and holes within the members may be simultaneously or subsequently stamped out, and the components then bent to their desired shape. It is a particular feature of the present invention that the end plate of the door reinforcing member have a thickness of at least 0.036", and preferably approximately 0.075". In order to reduce fabrication costs, the side plates and the end plate have a substantially uniform thickness. Also, the striker plate 14 preferably has a thickness equal to or greater than that of the end plate 26 to enhance structural integrity.

Both the striker plate and the door reinforcing plate may be coated or finished in a desired manner, e.g., bronze or gold finish, paint finish, to provide an aesthetically pleasing device. The finish on the door reinforcing member is not easily damaged, either when the member is installed or during operation of the door, due to the design of the components. The door reinforcing member and reinforced striker plate are preferably installed utilizing wood screws. Other securing members may be used, however, to secure each member to the door and doorjamb, respectively. As one example, the generally U-shaped door reinforcing member may be bonded by a suitable epoxy to the door, so that no securing member is visible. It is a particular feature of the invention that no action is required once the kit is installed to activate the security device.

According to the method of the present invention, the U-shaped door reinforcing member is formed as described above, including the cut-out within the end plate having a selected vertical height. The cut-out in the end plate preferably has a horizontal width extending to the side plates, and each of the side plates preferably is formed with a cutback having a substantially rectangular configuration. Depending upon the width of the side plates, recesses may be formed in each of the side plates for accommodating all or a portion of the door latching device, so that the door latching device does not have to be removed in order to install the door reinforcing member. The striker plate is formed having an aperture therein sized to receive the bolt member, and the vertical length of the latching device is controlled to be less than the vertical height of the cut-out in the door reinforcing member.

The door reinforcing member is mounted to the doorjamb such that each of the side plates is in planar engagement with a face of the door, and the end plate is in planar engagement with the end face of the door. The striker plate is mounted on the doorjamb so that the bolt passes through the striker plate into the receptacle in the doorjamb, and most importantly is positioned relative to the installed door reinforcing member so that the striker plate is received within the cut-out when the door is closed. No portion of the striker plate overlaps the end plate of the door reinforcing member, thereby minimizing the gap between the edge of the door and the doorjamb. The striker plate may optionally be provided with plate portions 62, 63 to cover a portion of the stop strip 60. Even for this embodiment, the door reinforcing plate need not engage the striker plate when the door is closed, as shown in FIG. 3. The door may thus stop against both the material of conventional stop strip 60 (for most of the vertical height of the door) and simultaneously against plate portion 63 (for that portion of the door vertically aligned with striker plate 14), thereby reducing damage to the kit components during normal use of the device while substantially enhancing structural integrity. If desired, the plate portion 64 of the striker plate 14 or the entire striker plate may be recessed into shallow receptacles cut into face board 48 and stop strip 60, as shown in FIG. 2, and the plate portions 63 and 62 configured to wrap around the stop strip 60 after those recesses are formed in the boards and stop strip. The door reinforcing member and latching plate may each be secured to the door and doorjamb with wooden screws.

Various modifications will be suggested from the foregoing disclosure, and such modifications and alterations should be considered within the scope of the present invention, which is not limited by the foregoing description or the exemplary embodiment.

What is claimed is:

1. A door security device for enhancing structural integrity between a door and a doorjamb, the door including a door latching device extending between an inner face and an outer face of the door and having a bolt member selectively movable outward from an end face of the door into a receptacle within the doorjamb to secure the door to the doorjamb when the door is closed, the bolt member being movable inward into the door and away from the receptacle within the doorjamb to release the door from the doorjamb, the security device comprising:

a generally U-shaped door reinforcing member for securing to the door such that one side plate of the reinforcing member is in planar engagement with the inner face of the door, another side plate of the reinforcing member is in planar engagement with the outer face of the door, and an end plate of the reinforcing member interconnecting the one side plate with the another side plate is in planar engagement with the end face of the door;

the end plate of the door reinforcing member having a cut-out therein having a vertical height of at least a selected distance;

a striker plate securable to the doorjamb, the striker plate having an aperture therein sized to receive the bolt such that the bolt selectably passes through the striker plate and into the receptacle within the doorjamb;

the striker plate having a vertical length less than the vertical height of the cut-out in the door reinforcing plate, such that the striker plate may be received within the cut-out when the door is closed without the striker plate overlapping the end plate of the reinforcing member;

a plurality of striker plate securing members for fixably securing the striker plate to the doorjamb.

2. The door security device as defined in claim 1, wherein the cut-out in the end plate has a horizontal width extending between the one side plate and the another side plate.

3. The door security device as defined in claim 2, wherein the one side plate includes a cutback extending to the cut-out in the end plate for receiving the striker plate when the door is closed.

4. The door security device as defined in claim 1, wherein each of the one side plate and the another side plate include a recess for receiving at least a portion of the door latching device extending outward from the inner face and the outer face of the door, respectively.

5. The door security device as defined in claim 1, wherein the striker plate further comprises:

a main plate portion having an aperture therein sized to receive the bolt member and further having an interior bent portion for striking engagement with the bolt member;

a door stop plate portion substantially perpendicular to the main plate portion; and an exterior plate portion substantially perpendicular to the door stop plate portion and substantially parallel to the main plate portion.

6. The door security device as defined in claim 5, further comprising:

the exterior plate including one or more exterior plate through holes therein; and at least one of the striker plate securing members being a screw extending through the one or more exterior plate through holes to secure the striker plate to the doorjamb.

7. The door security device as defined in claim 5, further comprising:

the another side plate of the reinforcing member including a cutback extending to the cut-out in the end plate for receiving the striker plate when the door is closed.

8. A door security device as defined in claim 1, wherein the end plate of the reinforcing member has a substantially uniform thickness of at least 0.060 inches.

9. The door security device as defined in claim 8, further comprising:

each of the one side plate and the another side plate of the reinforcing member having a thickness substantially equal to the thickness of the end plate;

the striker plate having a thickness substantially equal to or greater than the thickness of the end plate.

10. The door security device as defined in claim 1, further comprising:

the one side plate including one or more side plate through holes therein; and one or more reinforcing securing members each extending through a respective side plate through hole to secure the reinforcing member to the door.

11. A door security device for enhancing structural integrity between a door and a doorjamb, the door including an inner face and an outer face, a door latching device secured to the door and having a bolt member selectively movable outward from an end face of the door into a receptacle within the doorjamb to secure the door to the doorjamb when the door is closed, the bolt member being movable inward by the door latching device into the door and away from the receptacle within the doorjamb to release the door from the doorjamb, the security device comprising:

a generally U-shaped door reinforcing member for securing to the door such that one side plate of the reinforcing member is in planar engagement with the inner face of the door, another size plate of the reinforcing member is in planar engagement with the outer face of the door, and an end plate of the reinforcing member interconnecting the one side plate with the another side plate is in planar engagement with the end face of the door;

the end plate of the door reinforcing member having a cut-out therein having a vertical height of at least a selected distance and a horizontal width extending between the one side plate and the another side plate;

the one side plate and the another side plate each including a cutback extending to the cut-out in the end plate;

a striker plate securable to the doorjamb, the striker plate having an aperture therein sized to receive the bolt such that the bolt selectably passes through the striker plate and into the receptacle within the doorjamb;

the striker plate having a vertical length less than the vertical height of the cut-out in the door reinforcing plate, such that the striker plate may be received within the cut-out in the end plate and within the cutback in the one side plate and the another size plate when the door is closed without the striker plate overlapping the end plate of the reinforcing member; and a plurality of striker plate securing members for fixably securing the striker plate to the doorjamb.

12. The door security device as defined in claim 11, wherein each of the one side plate and the another side plate includes a recess for receiving at least a portion of the door latching device extending outward from the inner face and the outer face of the door, respectively.

13. The door security device as defined in claim 11, wherein the striker plate further comprises:

a main plate portion having an aperture therein sized to receive the bolt member and further having an interior bent portion for striking engagement with the bolt member;

a door stop plate portion substantially perpendicular to the main plate portion; and an exterior plate portion substantially perpendicular to the door stop plate portion and substantially parallel to the main plate portion.

14. The door security device as defined in claim 13, further comprising:

the exterior plate including one or more exterior plate through holes therein; and at least one of the striker plate securing members being a screw extending through the one or more exterior plate through holes to secure the striker plate to the doorjamb.

15. The door security device as defined in claim 11, further comprising:

the end plate of the reinforcing member having a substantially uniform thickness of at least 0.036 inches;

each of the one side plate and the another side plate of the reinforcing member having a thickness substantially equal to the thickness of the end plate; and the striker plate having a thickness substantially equal to or greater than the thickness of the end plate.

16. A method of enhancing structural integrity between a door and a doorjamb, the door including a door latching device extending between an inner face and an outer face of the door and having a bolt member selectively movable outward from an end face of the door into a receptacle within the doorjamb to secure the door to the doorjamb when the door is closed, the bolt member being movable inward into the door and away from the receptacle within the doorjamb to release the door from the doorjamb, the method comprising:

(a) forming a general U-shaped door reinforcing member including one side plate, another side plate, and an end plate interconnecting the one side plate and the another side plate;

(b) forming a cut-out within the end plate of the door reinforcing member having at least a selected vertical height;

(c) forming a striker plate securable to the doorjamb, the striker plate having an aperture therein sized to receive the bolt, the striker plate having a vertical length less than the vertical height of the cut-out in the door reinforcing plate;

(d) mounting the door reinforcing member to the door, such that the one side plate is in planar engagement with the inner face of the door, the another side plate is in planar engagement with the outer face of the door, and the end plate is in planar engagement with the end face of the door; and (e) mounting the striker plate to the doorjamb such that the bolt selectively passes through the striker plate and into the receptacle within the doorjamb when the door is closed, and such that the striker plate is received within the cut-out when the door is closed without the striker plate overlapping the end plate of the reinforcing member.

17. The method as defined in claim 16, wherein step (a) comprises:

stamping a plate having a substantially uniform thickness to a desired configuration; and bending the stamped plate to form the U-shaped door reinforcing member.

18. The method as defined in claim 16, further comprising:

forming a cutback in each of the one side plate and the another side plate extending to the cut-out in the end plate to receive the striker plate.

19. The method as defined in claim 16, further comprising:

forming the cut-out in the end plate with a horizontal width extending from the one side plate to the another side plate.

20. The method as defined in claim 16, further comprising;

forming a recess in at least one of the one side plate and the another side plate for receiving a portion of the door latching device.

* * * * *